US007518507B2

(12) United States Patent
Dalzell et al.

(10) Patent No.: US 7,518,507 B2
(45) Date of Patent: Apr. 14, 2009

(54) METHOD AND SYSTEM TO DETECT TAMPERING OF A CLOSED CHASSIS USING A PASSIVE FIBER OPTIC SENSOR

(75) Inventors: William J. Dalzell, Parrish, FL (US); James L. Tucker, Clearwater, FL (US); Scott G. Fleischman, Palmetto, FL (US)

(73) Assignee: Honeywell International Inc., Morristown, NJ (US)

( * ) Notice: Subject to any disclaimer, the term of this patent is extended or adjusted under 35 U.S.C. 154(b) by 193 days.

(21) Appl. No.: 11/273,060

(22) Filed: Nov. 14, 2005

(65) Prior Publication Data

US 2007/0109123 A1 May 17, 2007

(51) Int. Cl.
*G08B 21/00* (2006.01)

(52) U.S. Cl. ..... 340/540; 340/545.6; 340/555; 340/565; 340/815.42

(58) Field of Classification Search ..... 340/540, 340/545.6, 815.42, 568.2, 555, 565, 569, 340/570

See application file for complete search history.

(56) References Cited

U.S. PATENT DOCUMENTS 3,909,819 A * 9/1975 Radford ..... 340/545.3
4,155,077 A * 5/1979 Rohan et al. ..... 340/546
4,242,670 A * 12/1980 Smith ..... 340/555
4,255,745 A * 3/1981 Rohan et al. ..... 340/546
4,262,284 A * 4/1981 Stieff et al. ..... 340/541
4,367,460 A * 1/1983 Hodara ..... 340/550
4,591,709 A * 5/1986 Koechner et al. ..... 250/221
4,812,810 A * 3/1989 Query et al. ..... 340/545.3
4,829,174 A * 5/1989 Booth et al. ..... 250/221
5,111,184 A * 5/1992 Heaton et al. ..... 340/542
5,281,952 A * 1/1994 Dragan ..... 340/546
5,790,025 A * 8/1998 Amer et al. ..... 340/571
6,014,747 A * 1/2000 Fackenthall et al. ..... 726/34
6,553,930 B1 * 4/2003 Johnston et al. ..... 116/212
2005/0151069 A1 * 7/2005 Beinhocker ..... 250/227.15
2006/0107328 A1 * 5/2006 Frank et al. ..... 726/26

* cited by examiner

*Primary Examiner*—Jeff Hofsass
*Assistant Examiner*—Kerri L McNally
(74) *Attorney, Agent, or Firm*—McDonnell Boehnen Hulbert & Berghoff LLP

(57) ABSTRACT

A passive optical anti-tamper system including one or more light pipes, one or more light detectors and an alarm. The light pipes each include an input end and an output end and are located within a chassis with the one or more light detectors. The one or more light detectors are optically coupled to the output ends of the one or more light pipes. The alarm is operable to transmit a tamper-event-warning signal if an increased light level is detected by at least one detector.

13 Claims, 10 Drawing Sheets

METHOD AND SYSTEM TO DETECT TAMPERING OF A CLOSED CHASSIS USING A PASSIVE FIBER OPTIC SENSOR

GOVERNMENT LICENSE RIGHTS

The U.S. Government may have certain rights in the present invention as provided for by the terms of Government Contract #FA8650-04-C-8011 awarded by the United States Air Force.

BACKGROUND

The board layout and assorted microchips which comprise electrical and electro-optical systems within boxes or chassis often include proprietary circuit designs, source code, or encryption codes which need to be protected from reverse engineering or tampering. In order to protect the proprietary circuits from tampering, the board and chip manufacturers use various technologies including sealing the chips in an opaque or tamper resistant material, installing proprietary encryption code, or adding limited chassis or cover protection which could include security seals, or mechanical cut-off switches. However, over the last decade, these technologies, and anti-tamper coatings are not affective against more intrusive technologies and advanced software tools used by reverse engineers to determine how a particular board or device works or hack into the software or software codes. For example, reverse engineers drill small holes in the chassis and insert endoscope probes to view the proprietary contents of the chassis. They can also shine X-rays on individual die to find which cells are "OFF" while others are "ON." This provides a decoding mechanism for the reverse engineer.

If the information that a reverse engineer obtains by reverse engineering proprietary boards and/or chips is related to advanced military applications, the information leak may endanger national security. In particular if the military is not aware of the leak, confidential information could become available to the reverse engineer in the future, without the military knowing that their information is compromised. Additionally, the reverse engineer may be able invent ways to overcome the proprietary technology yielding the technology ineffective for its intended use.

If the information that a reverse engineer obtains by reverse engineering proprietary boards and/or chips is related to commercial applications, the information leak could be used to undermine the economic security of the commercial vendor. If a commercial vendor is unaware of the transgression on their proprietary information, they are unable to take steps to impose a penalty or to obtain financial restitution.

For the reasons stated above and for other reasons stated below which will become apparent to those skilled in the art upon reading and understanding the specification, there is a need in the art for protecting proprietary boards and chips and for alerting a vendor or customer if the proprietary information is breached. In some cases in order to keep the proprietary information away from reverse engineers, it is desirable to destroy the proprietary boards and chips if a tampering event occurs.

SUMMARY

The Embodiments of the present invention provide methods and systems for detecting tamper events using a passive optical fiber sensor and will be understood by reading and studying the following specification.

One aspect of the present invention provides a passive optical anti-tamper system. The system includes one or more light pipes, one or more light detectors and an alarm. The light pipes each include an input end and an output end and are located within a chassis with the one or more light detectors. The one or more light detectors are optically coupled to the output ends of the one or more light pipes. The alarm is operable to transmit a tamper-event-warning signal if an increased light level is detected by at least one detector.

Another aspect of the present invention provides a method to manufacture, the method including positioning one or more light detectors within a chassis with components to be protected from a tampering event, positioning a plurality of optical fibers within the chassis, wherein output ends of the optical fibers are optically coupled to the one or more light detectors and connecting an alarm in communication with the one or more detectors.

Yet another aspect of the present invention provides a method to passively detect a tampering event within a closed chassis. The method includes detecting an increase in light through at least one of a plurality of optical fibers within a chassis and generating a tamper-event-warning signal in response to the detecting of the increase in light.

Yet another aspect of the present invention provides a passive optical anti-tamper system. The system includes means for detecting an increased light level within a chassis in the event that a surface of the chassis is opened and means for generating a tamper-event warning signal responsive to the opening.

DRAWINGS

Embodiments of the present invention can be more easily understood and further advantages and uses thereof more readily apparent, when considered in view of the description of the preferred embodiments and the following figures.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical, optical and electrical changes may be made without departing from the scope of the present invention. The following detailed description is, therefore, not to be taken in a limiting sense.

Figure 1:
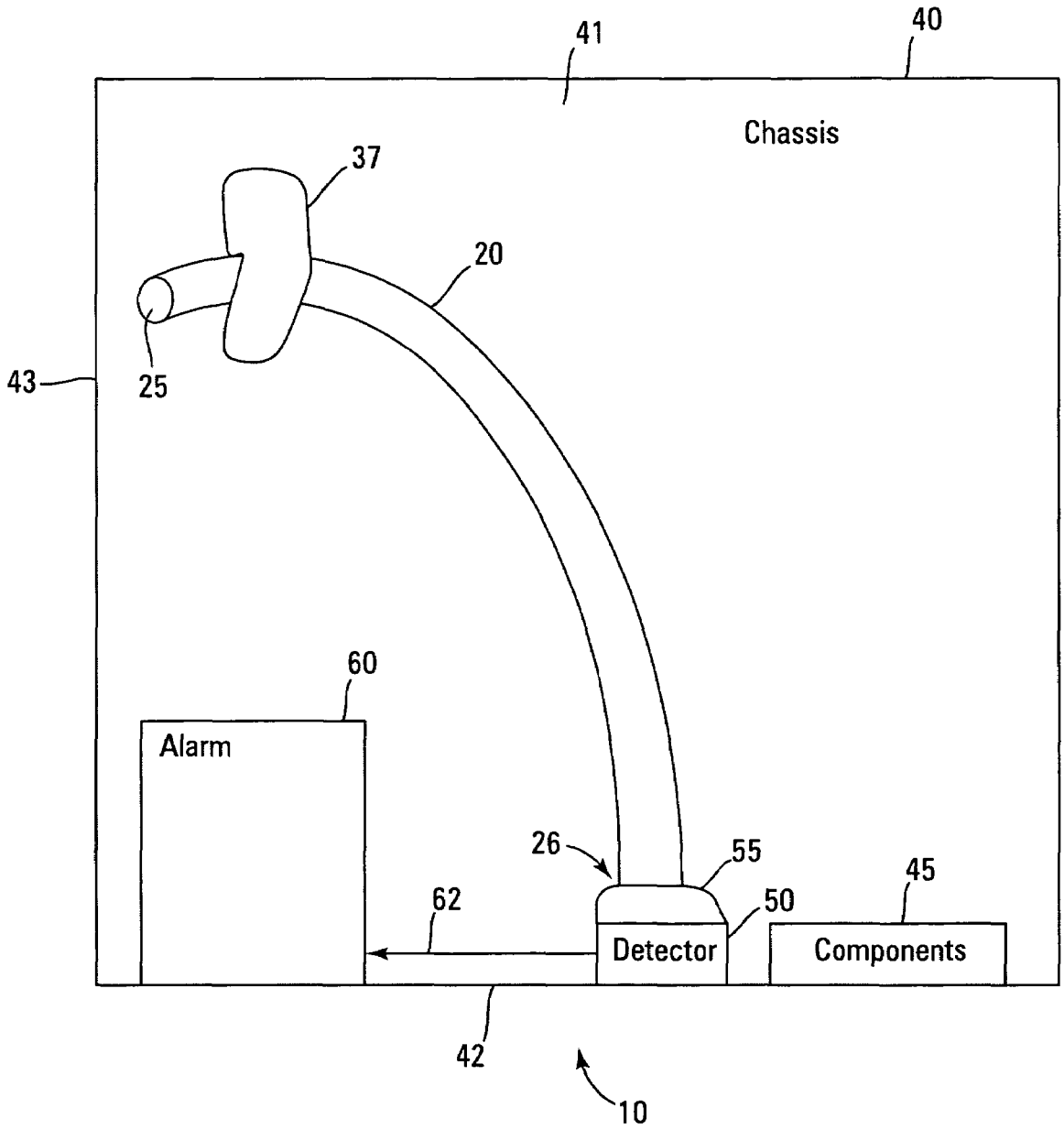
FIG. 1 is a cross-sectional side view of a first embodiment of a chassis enclosing a passive optical anti-tamper system.

FIG. 1 is a cross-sectional side-view of a chassis 40 enclosing a first embodiment of a passive optical anti-tamper system 10. The passive optical anti-tamper system 10 includes a light pipe 20, a light detector 50, an alarm 60 enclosed within a chassis 40 with a component 45 to be protected from a tampering event. The passive optical anti-tamper system 10 operates to detect a tampering event. A tampering event, as defined herein, occurs when a person opens the chassis 40 to analyze the component 45. The chassis 40 is opened when a surface of the chassis 40, such as the illustrated side surface 43, is removed or separated from the chassis 40. Likewise, the chassis 40 is opened when a portion of the surface of the chassis 40 is removed or separated from the chassis 40. The component 45, shown in FIG. 1 as one component, is representative of one or more components. The component 45 includes proprietary technology. The light pipe 20 includes an input end 25, shown obliquely, and an output end 26 shown in a side-view. The light pipe 20 is fixed to an inner surface 41 of the chassis 40 by a fixing structure 37 at a region of the light pipe 20 located near the input end 25.

The light pipe 20 transmits any light coupled into the input end 25. The light is transmitted from the input end 25 to the output end 26. The transmitted light is output from the output end 26 of the light pipe 20 and is optically coupled to the light detector 50, which is fixed to a bottom surface 42 of the chassis 40. A gel 55 that is located between the output end 26 and the light detector 50 has an appropriate index of refraction to reduce the intensity level of reflections between the output end 26 and the light detector 50. The gel 55 enhances the optical coupling between the light pipe 20 and the light detector 50.

An electrical connection, indicated by arrow 62, provides communication between the light detector 50 and the alarm 60. The alarm 60 includes circuits, such as digital IC or analog IC, that are operable to perform the functions of the alarm 60 as described below with reference to method 300 of FIG. 3. In one implementation of the passive optical anti-tamper system 10, the alarm 60 includes a processor operable to execute software and/or firmware that causes the processor to perform at least some of the processing described here as being performed by the passive optical anti-tamper system 10. At least a portion of such software and/or firmware executed by the processor and any related data structures are stored in memory during execution. In one implementation of the passive optical anti-tamper system 10, the alarm 60 includes a processor and a memory, which comprises any suitable memory now known or later developed such as, for example, random access memory (RAM), read only memory (ROM), and/or registers within the processor.

The light pipe 20 is one of a plastic or glass optical fiber, multimode optical fiber, single mode optical fiber, graded index rod, and flexible graded index rod. The selection of which fiber type and form can be optimized to meet the durability requirements, anti-tamper requirements, and cost requirements for a specific device. The phrase "optical fiber" and "light pipe" are used interchangeably throughout this document.

In one implementation of this embodiment of the passive optical anti-tamper system 10, the light detector 50 is fixed to a side surface 43 of the chassis 40. In another implementation of this embodiment of the passive optical anti-tamper system passive optical anti-tamper system 10, the light detector 50 is fixed to a surface of a board located in the chassis 40. In one implementation of this embodiment of the passive optical anti-tamper system 10 the gel 55 is not included.

Figure 2:
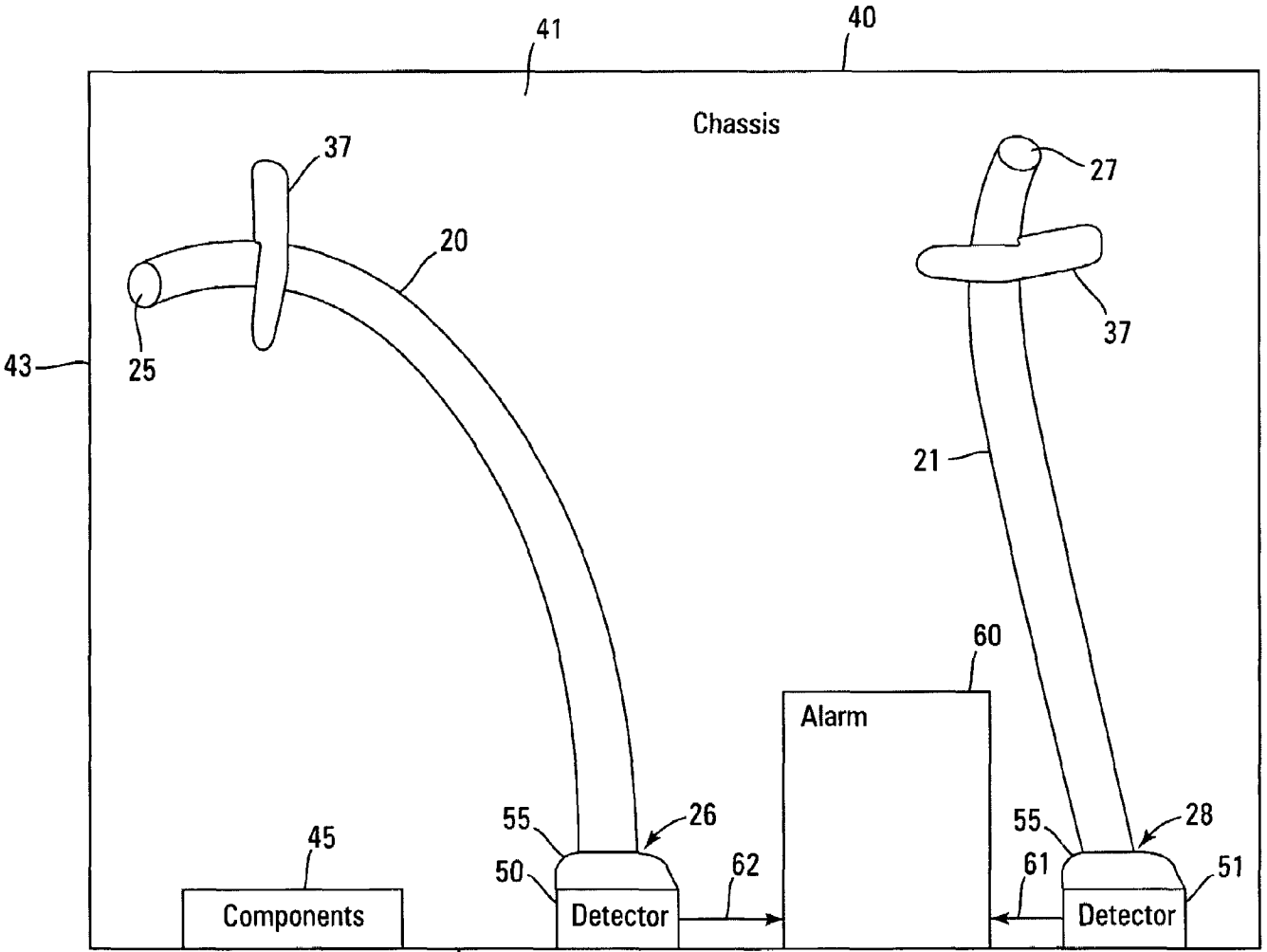
FIG. 2 is a cross-sectional side-view of a second embodiment of a chassis enclosing a passive optical anti-tamper system.

FIG. 2 is a cross-sectional side-view of a second embodiment of a passive optical anti-tamper system 11. The passive optical anti-tamper system 11 functions in a manner similar to that of passive optical anti-tamper system 10. Passive optical anti-tamper system 11 includes two light pipes 20 and 21. Light pipe 21 is substantially the same as light pipe 20 and is optically coupled to a light detector 51. Specifically, light pipe 21 includes an input end 27, shown obliquely, and an output end 28 shown in a side-view. The light pipe 20 is fixed to the inner surface 41 of the chassis 40. As shown in FIG. 2, a fixing structure 37 attaches a region of the light pipe 21 to the inner surface 41. The fixing structure 37 is located near the input end 27.

An electrical connection, indicated by arrow 61, provides communication between the light detector 51 and the alarm 60. Alarm 60 functions as described above with reference to FIG. 1. The input end 25 is pointed in one direction while the input end 27 is pointed in another direction.

The light pipe 21 transmits any light coupled into the input end 27. The light is transmitted from the input end 27 to the output end 28. The transmitted light is output from the output end 28 of the light pipe 21 and is optically coupled to the light detector 51, which is fixed to a bottom surface 42 of the chassis 40. A gel 55 functions to enhance optical coupling between light pipe 21 and light detector 51 as described above for light pipe 20 and light detector 50 with reference to FIG. 1. In one implementation of this embodiment of the passive optical anti-tamper system 11, the detector 50 is on a different surface than detector 51 within the chassis 40. In another implementation of this embodiment of the passive optical anti-tamper system 11, there are more than two light detectors 50 and 51. In one implementation of this embodiment, each of the surfaces internal to the surface of the chassis 40 has at least one light detector 50 attached to it with a light pipe 20 coupled to it. The input ends 25 and 27 are fixed within the chassis 40 to face in a plurality of directions.

Figure 3:
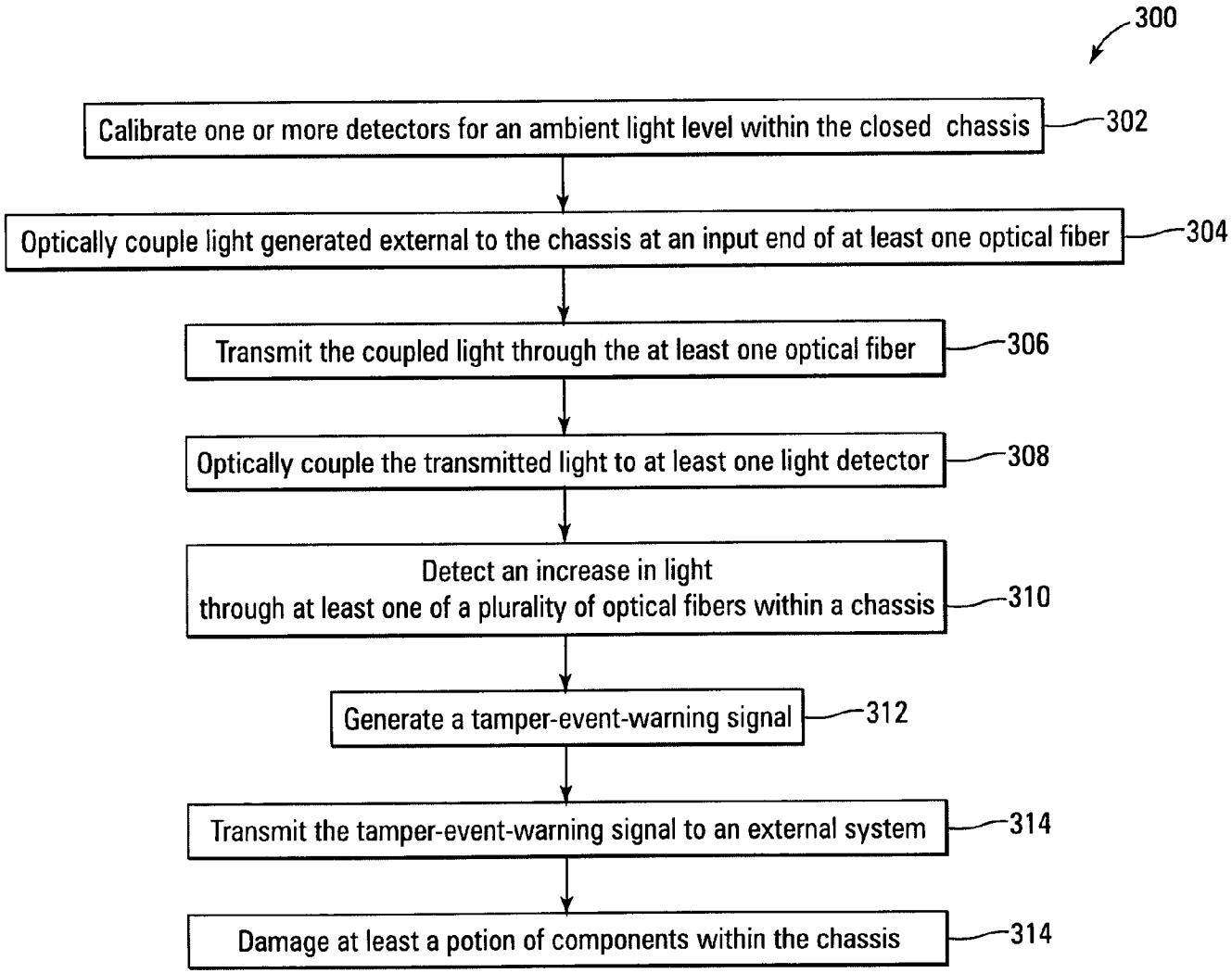
FIG. 3 is a method to passively detect a tampering event within a chassis.
Figure 4:
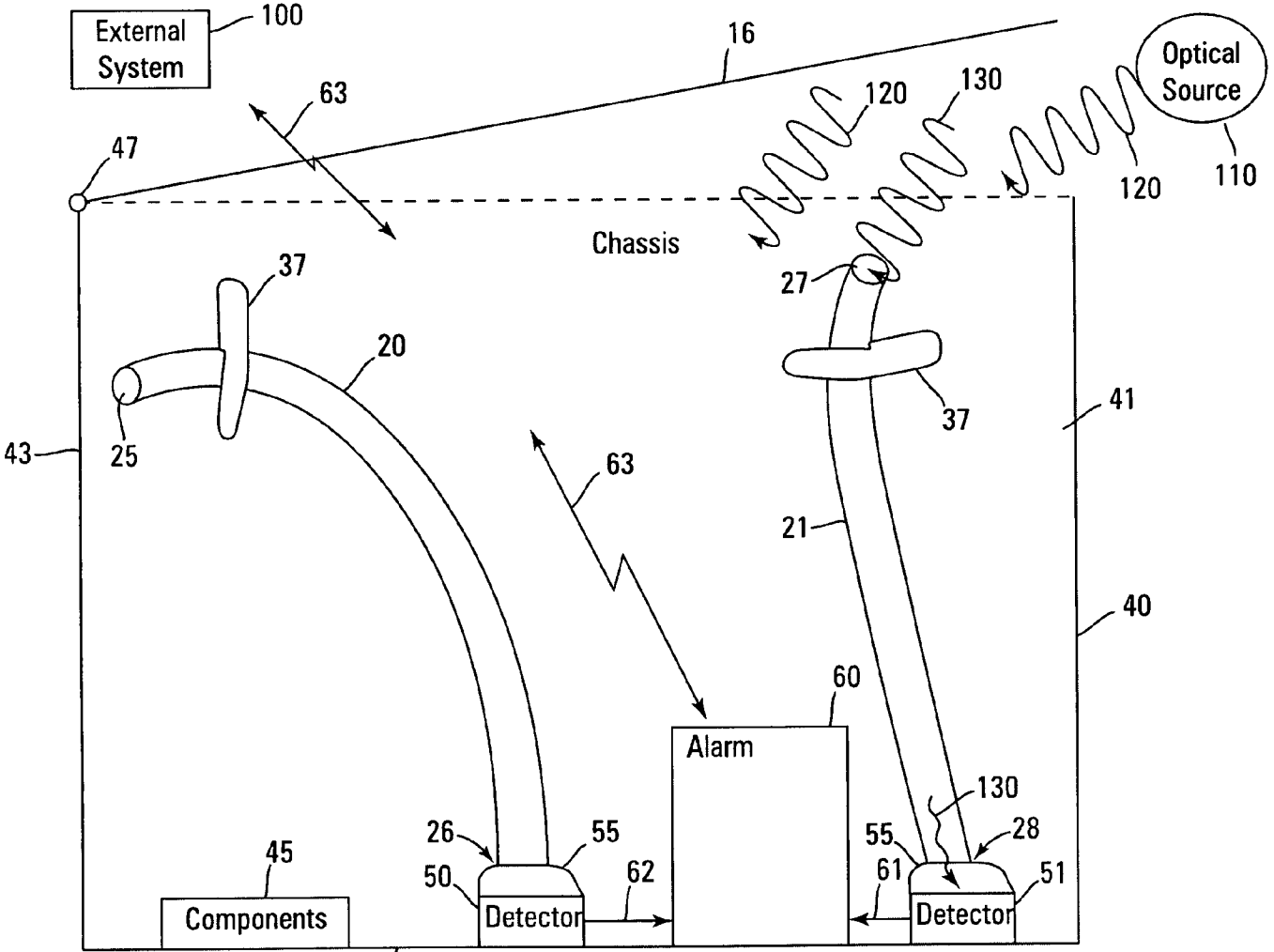
FIG. 4 is a cross-sectional side-view of an embodiment of the passive optical anti-tamper system of FIG. 2 in the process of transmitting a tamper-event-warning signal.
Figure 5:
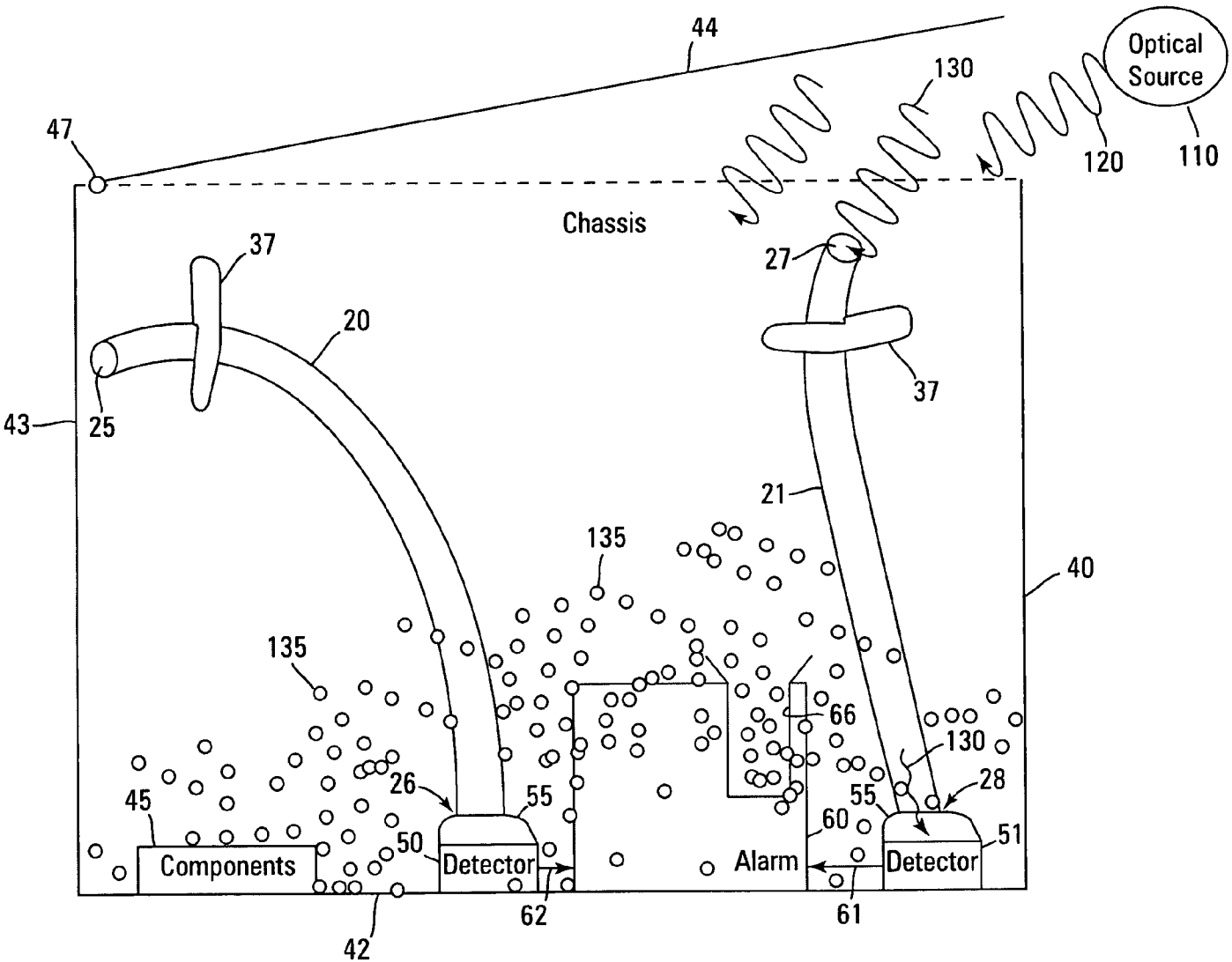
FIG. 5 is a cross-sectional side-view of an embodiment of the passive optical anti-tamper system of FIG. 2 in the process of damaging at least a portion of the components within the chassis responsive to the tamper-event-warning signal.

FIG. 3 is a method 300 to passively detect a tampering event within a chassis 40. The method is described with reference to the passive optical anti-tamper system 11 as illustrated in FIGS. 2, 4 and 5. FIG. 4 is a cross-sectional side-view of an embodiment of the passive optical anti-tamper system 11 of FIG. 2 in the process of transmitting a tamper-event-warning signal 63. The term "tamper-event-warning signal" as defined herein, includes one or more output events operable to notify one or more systems or people that a chassis has been opened, such as an audio alert, a signal transmitted to an external system, and a trigger of an visual indicator at an external system. FIG. 5 is a cross-sectional side-view of an embodiment of the passive optical anti-tamper system 11 of FIG. 2 in the process of damaging at least a portion of the components 45 within the chassis 40 responsive to the tamper-event-warning signal. As defined herein, the term "damaging" refers to making the protected software and/or hardware inoperable and/or irretrievable. The alarm 60 has stored in computer readable medium at least one computer program including computer readable code to perform the operations described with reference to method 300.

The one or more light detectors 50 and 51 of the passive optical anti-tamper system 11 are calibrated for the ambient light level in the closed chassis 40 (block 302). The optical fibers 20 and 21 are fixed as shown in FIG. 2. The chassis 40 is sealed to prevent any light from external to the chassis 40 from entering the chassis. There may be one or more light sources within the chassis 40 for normal operation of the components 45. In one implementation of the exemplary passive optical anti-tamper system 11 of FIG. 2, the components 45 include light emitting diodes. Once the chassis 40 is closed, the alarm 60 is triggered to receive signals from the light detectors 50 and 51. The signals indicate a light level in the chassis 40 that is the calibrated light level. In one implementation of the exemplary passive optical anti-tamper system 11 of FIG. 2, the processor that calibrates the passive optical anti-tamper system 11 is external to the alarm 60.

When the chassis 40 is opened, as shown in FIGS. 4 and 5, a tampering event occurs and light 130 generated external to the chassis 40 by optical source 110 is optically coupled to an input end 27 of at least one of the light pipe 21 (block 304). The light 130 is optically coupled into input end 27 since the light 130 propagates in the direction that is within the acceptance angle of the light pipe 21, as known in the art. The light 120 generated external to the chassis 40 is not optically coupled to an input end 25 of the light pipes 20 or 21 since the light 120 is not propagating within the light acceptance angle of the light pipes 20 or 21 as known in the art.

In the embodiment shown in FIGS. 4 and 5, the chassis 40 is opened by rotating the top surface 16 about the hinge 47 shown in cross section. In one implementation of the exemplary passive optical anti-tamper system 11 of FIG. 2, the tampering event occurs when a hole is drilled through any surface of the chassis 40.

The light 130 coupled into input end 27 of light pipe 21 is transmitted down the core of the light pipe 21 to the output end 28 of the light pipe (block 306). The output end 28 of the light pipe is positioned with respect to the light detector 51 in order to couple light 130 to the light detector 51 (block 308). The light level incident on the light detector 51 is now greater than the light level incident on the light detector 51 during the calibration process described above with reference to block 302.

The light detector 51 transmits a signal indicative of the intensity level of light 130 incident on the light detector 51. The signal is transmitted to the alarm 60 through the electrical connection, indicated by arrow 61. In this manner the passive optical anti-tamper system 11 detects an increase in light through at least one of a plurality of optical fibers 20 and 21 within a chassis 40 (block 310).

The alarm 60 receives the signal indicative of the light 130 incident on the light detector 51. The circuitry within the alarm 60 is operable to retrieve the calibrated light level for the calibrated light detector 51 and compare the values of the calibrated light level and the light level when light 130 is incident on the light detector 51. The alarm 60 determines that there is an increased light level based on the comparison and generates a tamper-event-warning signal (block 312). Thus, the alarm 60 generates a tamper-event-warning signal in response to detecting the increased light level at light detector 51 when the light 130 is incident on the light detector 51.

In one implementation of the method 300, after the alarm 60 generates a tamper-event-warning signal responsive to the opening of the chassis, the alarm 60 in the passive optical anti-tamper system 11 transmits the tamper-event-warning signal 63 to an external system 100 (block 314). As shown in FIG. 4, the tamper-event-warning signal 63 is transmitted as a radio frequency signal to the external system 100. In one implementation of this embodiment of block 314 the method 300, the radio frequency signal is generated by a transmitter. In another implementation of this embodiment of block 314 the method 300, the radio frequency signal is generated by a transceiver. In another implementation of block 314 of method 300, the tamper-event-warning signal 63 is a chassis-open-warning signal.

In another implementation of the method 300, the passive optical anti-tamper system 11 damages at least a portion of the components 45 in the chassis 40 (block 316) when the alarm 60 generates a tamper-event-warning signal. As shown in FIG. 5, the alarm 60 includes a container 66. When the alarm 60 generates a tamper-event-warning signal, the container 66 is automatically triggered by the alarm 60 to open. When the container 66 opens, a material 135 in the container is emitted and disperses within the open chassis 40. The material 135 is indicated as a plurality of circles to represent molecules or groups of molecules of the diffusing material 135. The material 135 is operable to destroy or damage at least a portion of the components 45 that are being protected to prevent proprietary information from being retrieved from the components 45 in the open chassis 40. In one implementation of this embodiment of block 316 of method 300, the container 66 opens due to a mechanical switch that operates responsive to the trigger. In another implementation of this embodiment of block 316 of method 300, the container 66 opens due to an electric and/or electro-optic switch that operates responsive to the trigger.

In one implementation of this embodiment of block 316 of method 300, the material 135 is a caustic chemical that erodes conformal coatings and the trace lines within and/or connecting components 45. The caustic chemical can be in a gas or liquid state. In another implementation of this embodiment of block 316 of method 300, the components 45 are powered to drive the signal lines and material 135 is a conductive substance that electrically shorts conductive trace lines and device pins connecting and/or within the circuits of the components 45. In this embodiment, the material 135 does not short the power and ground connections of the component 45 powered to drive the signal lines while shorting the output drivers of functional circuits within the components 45. In yet another implementation of this embodiment of block 316 of method 300, more than one material is emitted and dispersed within the chassis 40. In yet another implementation of this embodiment of block 316 of method 300, more than one material is emitted and dispersed within the chassis 40 to form a third material 135 that damages or destroys at least the proprietary components within the chassis 40.

Figure 6:
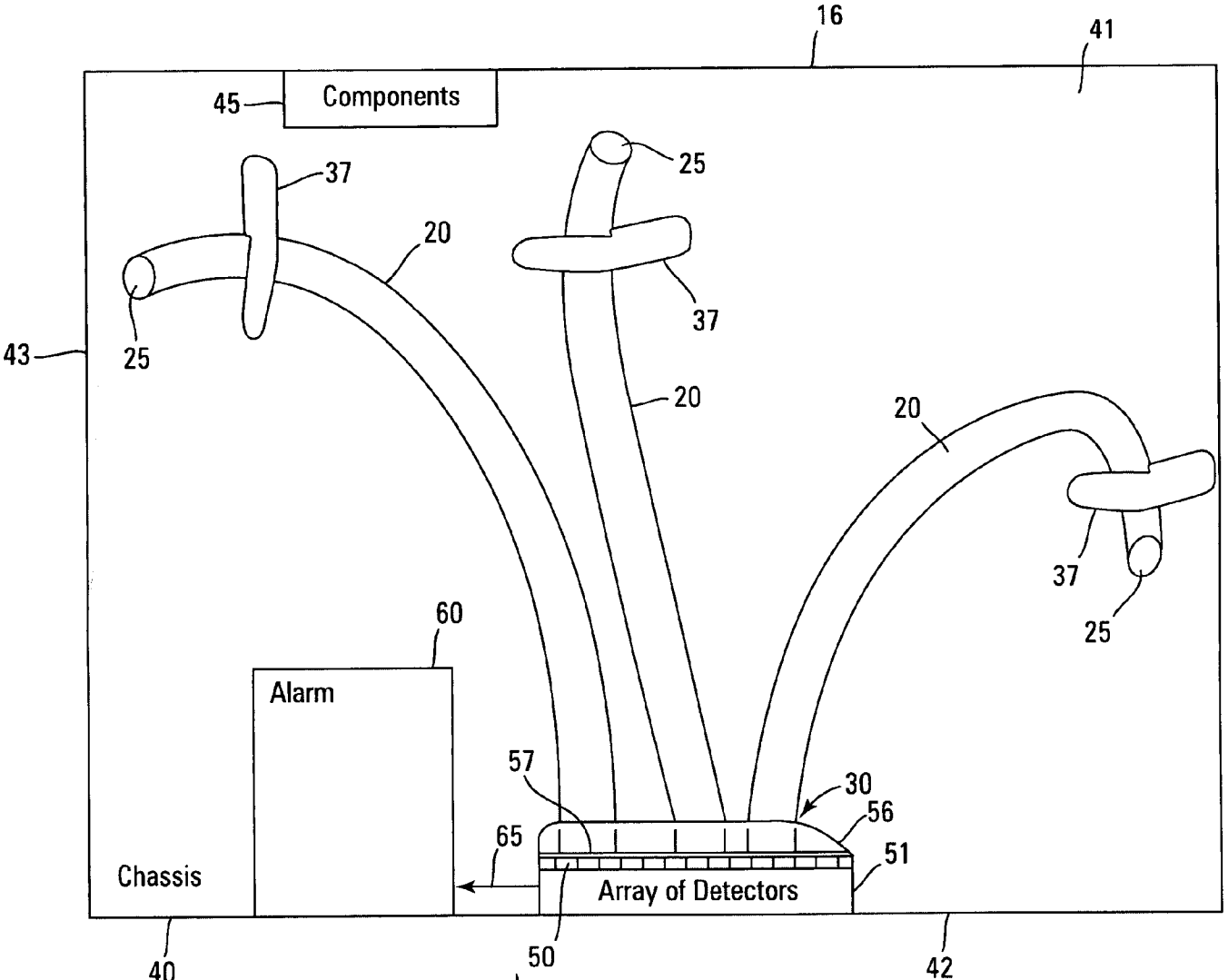
FIG. 6 is a cross-sectional side-view of a chassis enclosing a third embodiment of a passive optical anti-tamper system.

FIG. 6 is a cross-sectional side-view of a third embodiment of a passive optical anti-tamper system 12. The function of the passive optical anti-tamper system 12 is the same as the function of the passive optical anti-tamper system 11. The passive optical anti-tamper system 12 includes a plurality of light pipes 20 that are fixed near the input ends 25 to surfaces internal to the chassis 40 by fixing structures 37. The output ends 30 of the light pipes 20 are all optically coupled to an array of light detectors 51. The output ends 30 can be held in position by optically transparent epoxy 57. An electrical connection, indicated by arrow 65, provides communication between the array of light detectors 51 and the alarm 60.

The active surface of the array of light detectors 51 that is not coupled to a light pipe 20 is coated with an opaque material 56. The layer of opaque material 56 overlays the one or more light detectors 50 in the array of light detectors 51 not covered by the output end 30 of the one or more light pipes 20.

Also the layer of opaque material 56 overlays any portions of the one or more light detectors in the array of light detectors 51 not covered by the output end 30 of the one or more light pipes 20. The opaque material 56 prevents any light from the components 45 from reaching the array of light detectors 51.

This is useful if light entering the chassis 40 from external to the chassis 40 has a low intensity level. In an exemplary a tamper event, a small hole is drilled through the top surface 16 of the chassis 40 and the light entering the chassis 40 from outside the chassis has a low intensity level. In this case, it is desirable that the array of light detectors 51 is covered by an opaque material. Otherwise, any light generated by the components 45 creates a calibrated light level that has a relatively high intensity with respect to the light that reaches the array of light detectors 51 when the a small hole drilled through the top surface 16 of the chassis 40.

The array of light detectors 51 includes one of an array of photosensitive elements, photosensitive pixels, a charge-coupled device (CCD), an array of photo-detectors, and combinations thereof.

Figure 7:
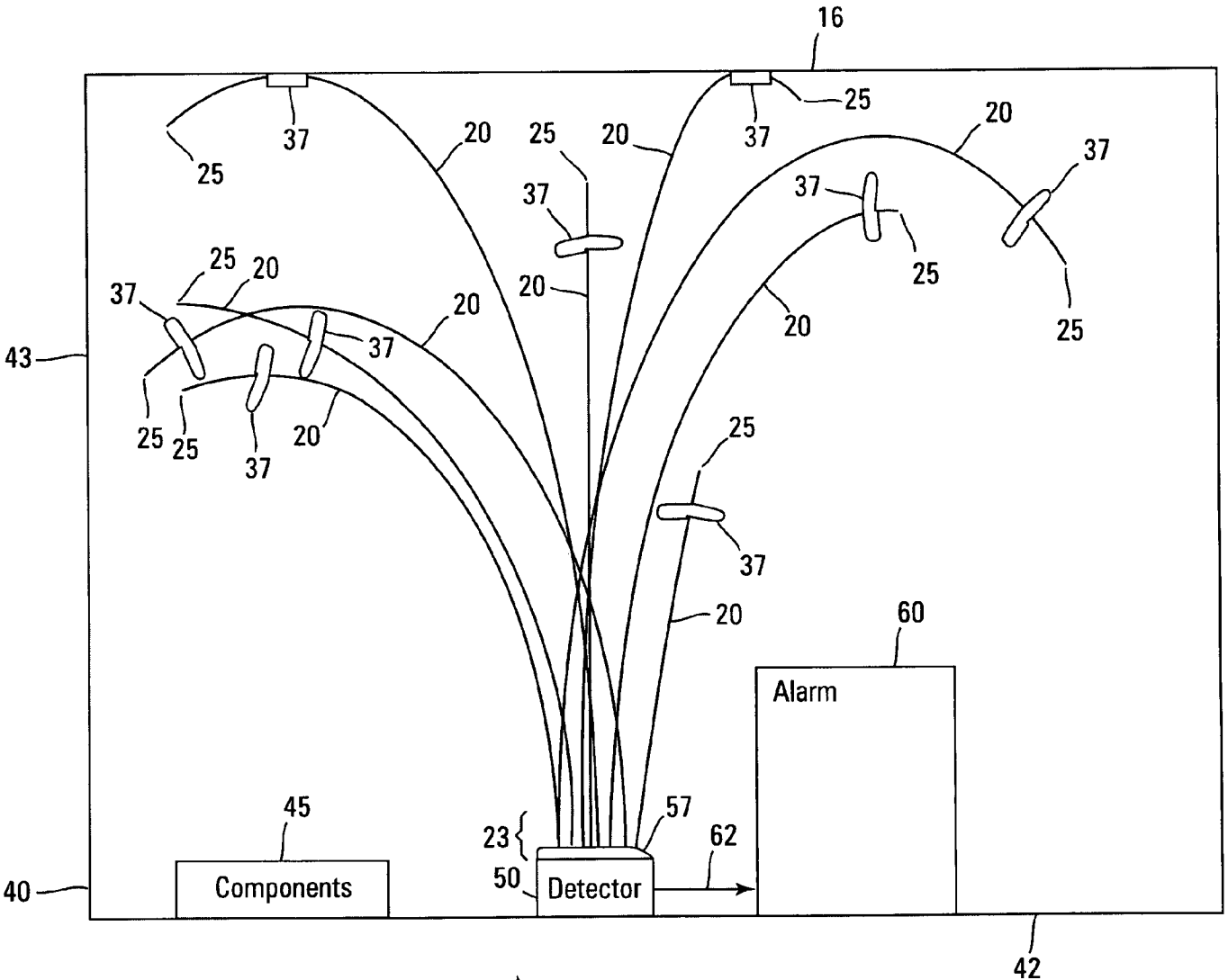
FIG. 7 is a cross-sectional side-view of a chassis enclosing a fourth embodiment of a passive optical anti-tamper system.

FIG. 7 is a cross-sectional side-view of a fourth embodiment of a passive optical anti-tamper system 13. The function of the passive optical anti-tamper system 13 is the same as the function of the passive optical anti-tamper system 11. The passive optical anti-tamper system 13 includes a plurality of light pipes 20. A region of each light pipe 20 towards the input end 25 is fixed to a surface internal to the chassis 40 by a fixing structure 37. The output ends 30 of the light pipes 20 are bundled together to form a bundled-output end 23. As shown in FIG. 7, the unbundled input ends 25 are splayed within the chassis 40 and attached near the input ends 25 to surfaces internal to the chassis 40 by fixing structures 37. The bundled-output end 23 is optically coupled to light detector 50. In one implementation of this embodiment, the detector is a large surface area detector. The bundled-output end 23 is held in position by optically transparent epoxy 57.

Figure 8:
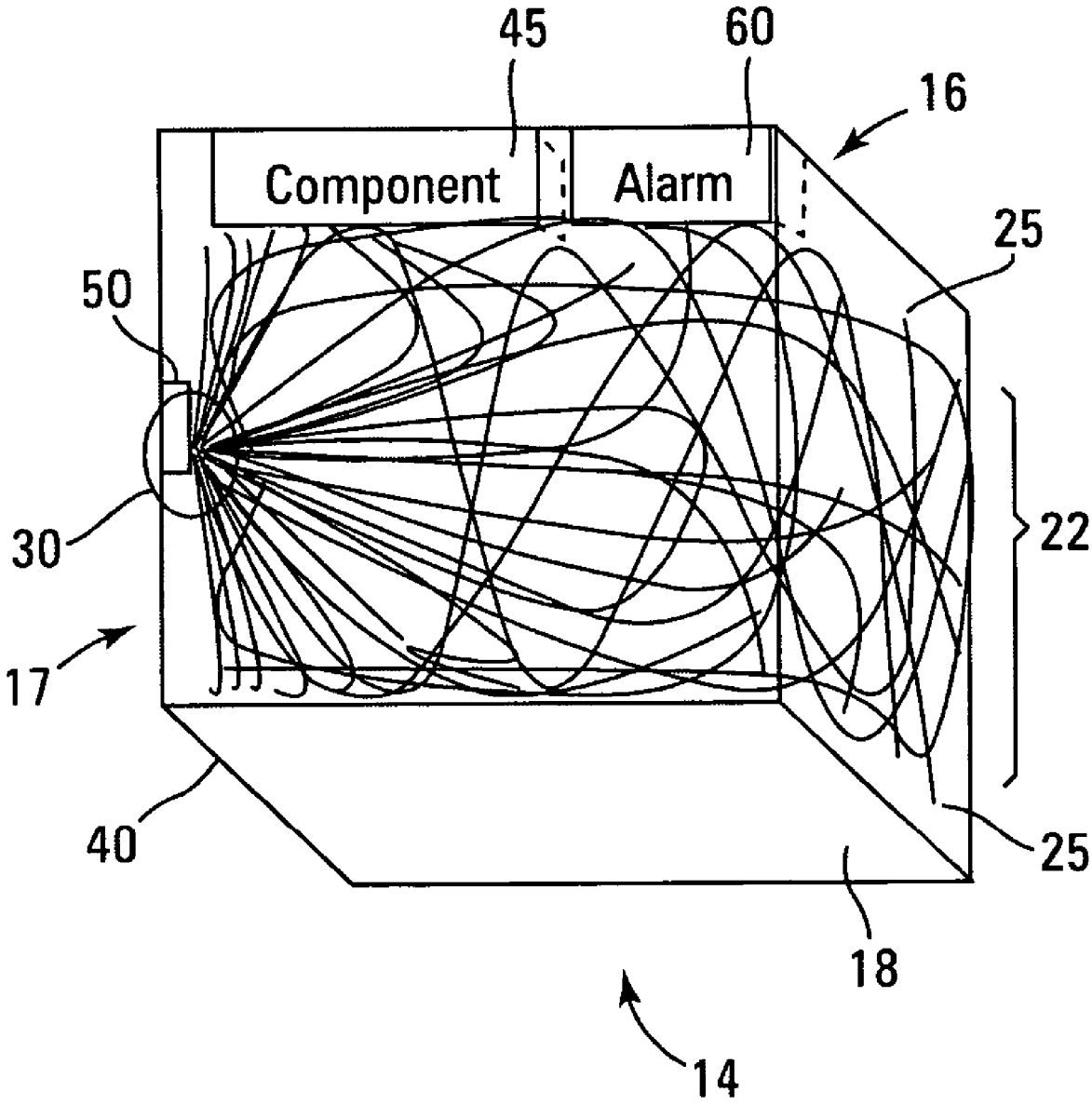
FIG. 8 is an oblique view of a fifth embodiment of a passive optical anti-tamper system.

FIG. 8 is an oblique view of a fifth embodiment of a passive optical anti-tamper system 14. The function of the passive optical anti-tamper system 14 is the same as the function of the passive optical anti-tamper system 11. FIG. 8 shows the three dimensions of chassis 40. The bottom surface 18 is opaque to provide a visual reference. As shown in FIG. 8, a plurality of optical fibers 22 are coupled at the output ends 30 to a light detector 50 located on a side surface 17. The components 45 to be protected are on a top surface 16 of the chassis 40. The plurality of optical fibers 22 loosely fill the chassis 40 and the input ends 25 are facing all directions within the chassis. In one implementation of this embodiment, the optical fibers 22 are sprayed with a holding material that coats the optical fibers 22 and hardens on the surface of the optical fibers 22 to hold them is a rigid position prior to calibration of the passive optical anti-tamper system 14.

Figure 9:
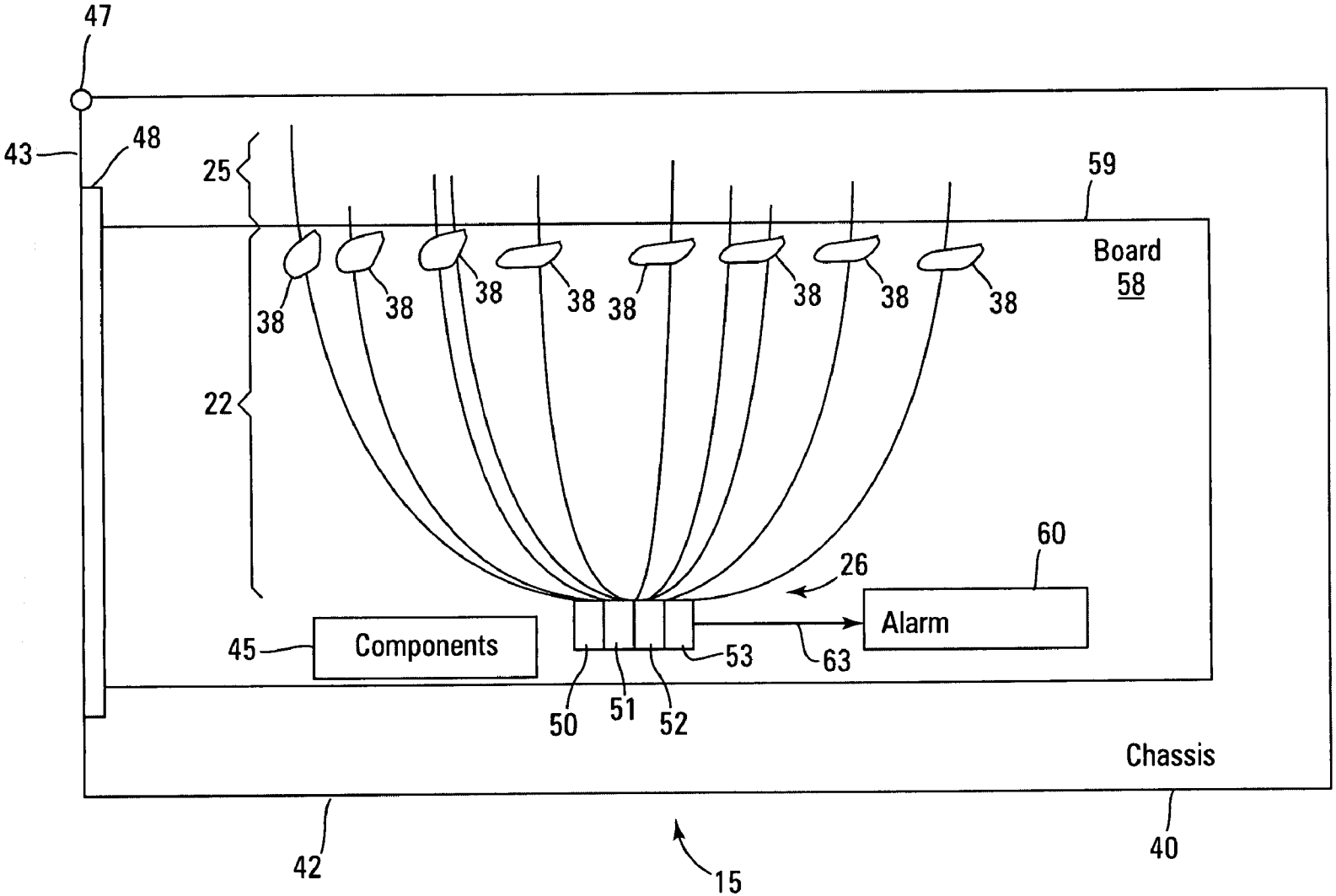
FIG. 9 is a side cross-sectional view of a chassis enclosing a sixth embodiment of a passive optical anti-tamper system.

FIG. 9 is a side cross-sectional view of a chassis 40 enclosing a sixth embodiment of a passive optical anti-tamper system 15. The function of the passive optical anti-tamper system 15 is the same as the function of the passive optical anti-tamper system 13 of FIG. 7. The passive optical anti-tamper system 15 and the components 45 to be protected are attached to a board 58. The board 58 is fixed to a side surface 43 of the chassis 40. For example, the board 58 is plugged into a slot 48, such as a backplane connector. The passive optical anti-tamper system 15 includes a plurality of optical fibers 22, a plurality of light detectors 50-53 and an alarm 60 in communication with the light detectors 50-53. Each detector 50-53 has an electrical connection, indicated by arrow 63, to provide communication between each of the light detectors 50-53 and the alarm 60. The alarm 60 includes required circuits to determine, during the course of a tampering event, which of the detectors 50-53 is sensing light.

The plurality of optical fibers 22 are fixed to the board 58. The input ends 25 are splayed and fixed with an adhesive 38 at a region of the optical fibers 22 located near the input ends 25 so that the input ends 25 extend over the edge 59 of the board 58 to substantially face the top surface 16 of the chassis 40. The plurality of optical fibers 22 each coupled at output ends 26 to one of a detector 50-53. In one implementation of the passive optical anti-tamper system 15, the input ends 25 are flush with one or more edges, such as edge 59, of the board 58 and substantially face the surface of the chassis 40 that is closest to the respective edge.

The detectors 50-53 each sense a different range of wavelengths. In one implementation of the passive optical anti-tamper system 15, detector 50 senses wavelengths in the infra-red spectral range, detector 51 senses wavelengths in the red spectral range, detector 52 senses wavelengths in the blue-green spectral range and detector 53 senses wavelengths in the ultra-violet spectral range. In another implementation of the passive optical anti-tamper system 15, more than one optical fiber 22 is optically coupled at the output end 26 to detector 50, more than one optical fiber 22 is optically coupled at the output end 26 to detector 51, more than one optical fiber 22 is optically coupled at the output end 26 to detector 52, and more than one optical fiber 22 is optically coupled at the output end 26 to detector 53. In yet another implementation of the passive optical anti-tamper system 15, there are a plurality of detectors for each of the ranges of wavelengths.

The top surface 16 of the chassis 40 is operable to rotate away from the bottom surface 42 of the chassis 40 about the hinge 47. In the event that someone opens the chassis 40 light generated external to the chassis 40 is optically coupled into the input ends 25 of the optical fibers 22 which are fixed to face in substantially the same direction toward the top surface 16.

One implementation of the passive optical anti-tamper system 15, includes a plurality of boards 58 in one chassis 40. In another implementation of the passive optical anti-tamper system 15, the passive optical anti-tamper system 15 attached to a board 58 and the components 45 to be protected are attached to another board located within the chassis 40. In yet another implementation of the passive optical anti-tamper system 15, the optical fibers 22 are fixed to substantially face two or more surfaces of the chassis 40. In yet another implementation of the passive optical anti-tamper system 15, the optical fibers 22 are fixed to substantially face at least one surface of the chassis 40 so that the end faces 25 are near the surface that they face.

In all the embodiments of the passive optical anti-tamper systems described herein, the length of the light pipes 20 is a function of the dimensions of the chassis 40. The lengths of the light pipes 20 are not required to be the same length or approximately the same length. In one implementation of the embodiments of the passive optical anti-tamper system, the light detectors 50 and 51 are operable to detect low levels of light. The light detectors 50 and 51 do not need to detect light at high data rates and thus, they are not required to be high speed detectors. Therefore, light detectors 50 and 51 are relatively inexpensive slow detectors and/or large area detectors. The light detectors 50 and 51 are operable to detect visible light. In one implementation of this embodiment, the detectors 50 and 51 are operable to detect light beyond the range of visible light.

Figure 10:
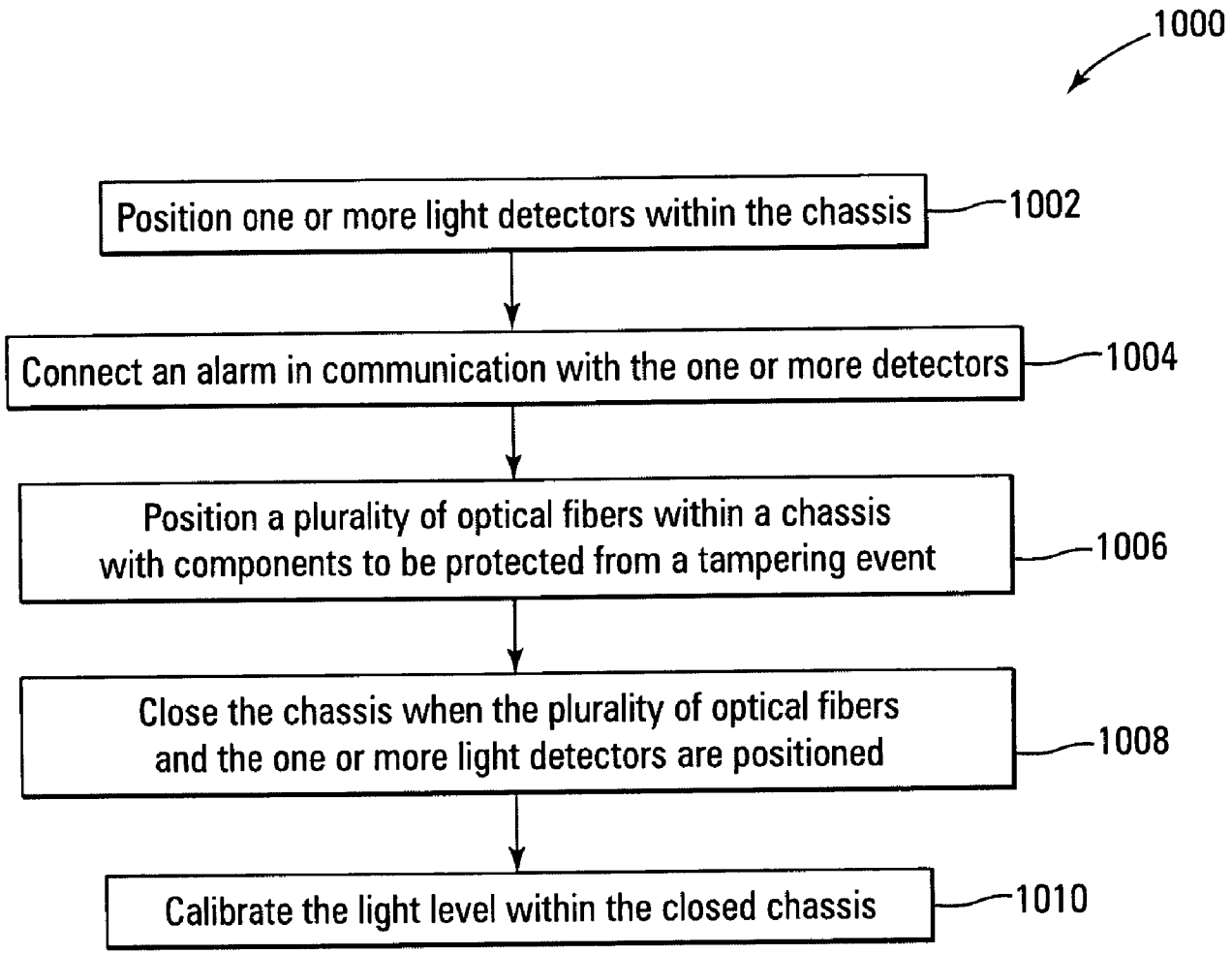
FIG. 10 is an embodiment of a method to manufacture a passive optical anti-tamper system.

FIG. 10 is an embodiment of a method 1000 to manufacture a passive optical anti-tamper system. The method of manufacture is described for passive optical anti-tamper system 11 as shown in FIG. 2. The method of manufacture for other passive optical anti-tamper systems, such as passive optical anti-tamper system 10 and passive optical anti-tamper system 12-15, are similar as is understandable by those skilled in the art.

At block 1002, one or more light detectors 50 are positioned within the chassis 40 along with the components 45 to be protected and the alarm 60. At block 1004, the alarm 60 is connected to communicate with the light detectors 50 and 51. The light detector 50 is electrically connected to the alarm 60 as indicated by arrow 62 (FIG. 2) and the light detector 51 is electrically connected to communicate with the alarm 60 as indicated by arrow 61 (FIG. 2).

At block 1006, optical fibers 22 and 21 are positioned within the chassis 40 with the components 45 to be protected. The output end 26 of the optical fiber 22 is positioned in a manner to allow any light emitted from the output end 26 to be coupled into the light detector 50. Likewise, the output end 28 of the optical fiber 21 is positioned in a manner to allow any light emitted from the output end 28 to be coupled into the light detector 51.

At block 1008, the chassis 40 is closed when the detectors 50 and 51 are positioned to receive light transmitted through the respective optical fibers 22 and 21. At block 1010, the passive optical anti-tamper system 11 is calibrated as described above with reference to block 302 in method 300 of FIG. 3.

Although specific embodiments have been illustrated and described herein, it will be appreciated by those of skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A passive optical anti-tamper system, the system comprising:

one or more light pipes each including an input end and an output end, the one or more light pipes located within a chassis, wherein the one or more light pipes comprise a plurality of optical fibers bundled to form a bundled-output end and wherein the input ends of the plurality of optical fibers are unbundled;

one or more light detectors located within the chassis, the one or more light detectors optically coupled to the output ends of the one or more light pipes; and an alarm in communication with the one or more detectors, wherein the alarm is operable to transmit a tamper-event-warning signal if an increased light level is detected by at least one detector.

2. The system of claim 1, the system further comprising:

a gel located at an interface between the one or more detectors and the respective output end of the one or more light pipes, the gel operable to increase an efficiency of the optical coupling.

3. The system of claim 1, wherein the unbundled input ends of the plurality of optical fibers are splayed.

4. The system of claim 1, wherein the unbundled input ends of the plurality of optical fibers are fixed within the chassis to face in a plurality of directions.

5. The system of claim 1, wherein the output ends of the plurality of optical fibers are coupled to more than one detector, wherein the more than one detectors sense more than one range of wavelengths.

6. The system of claim 5, wherein the plurality of optical fibers are fixed on a board in the chassis and wherein the input ends of the plurality of optical fibers face in substantially the same direction.

7. The system of claim 1, wherein the one or more light detectors include one of an array of photosensitive elements, photosensitive pixels, a charge-coupled device, an array of photo-detectors, and combinations thereof.

8. The system of claim 1, further comprising:

an opaque layer overlying at least a portion of the one or more light detectors not covered by the output end of the one or more light pipes.

9. The system of claim 1, wherein each light pipe is fixed at the input end and is coupled to a respective light detector at the output end, wherein the fixed input ends face in a plurality of directions.

10. The system of claim 9, wherein the one or more light pipes comprise one of plastic optical fibers, multimode optical fibers, single mode optical fibers, graded index rods, flexible graded index rods, and combinations thereof.

11. The system of claim 1, wherein the one or more light pipes comprise one of plastic optical fibers, multimode optical fibers, single mode optical fibers, graded index rods, flexible graded index rods, and combinations thereof.

12. The system of claim 1, the system further comprising:

means for transmitting the tamper-event-warning signal to an external system.

13. The system of claim 1, the system further comprising:

means for damaging at least a portion of components within the chassis responsive to the transmitting of the tamper-event-warning signal.

* * * * *